US009062281B2

(12) United States Patent
Keningley

(10) Patent No.: US 9,062,281 B2
(45) **Date of Patent: *Jun. 23, 2015**

(54) PARTICULATE DETERGENT COMPOSITIONS COMPRISING FLUORESCER

(75) Inventor: Stephen Thomas Keningley, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/878,444

(22) PCT Filed: Sep. 1, 2011

(86) PCT No.: PCT/EP2011/065124

§ 371 (c)(1),
(2), (4) Date: Jul. 9, 2013

(87) PCT Pub. No.: WO2012/048945

PCT Pub. Date: Apr. 19, 2012

(65) Prior Publication Data

US 2013/0281346 A1 Oct. 24, 2013

(30) Foreign Application Priority Data

Oct. 14, 2010 (EP) ..... 10187495

(51) Int. Cl.

| | |
|---|---|
| ***C11D 17/06*** | (2006.01) |
| ***C11D 3/04*** | (2006.01) |
| ***C11D 3/42*** | (2006.01) |
| ***C11D 3/50*** | (2006.01) |
| ***C11D 3/37*** | (2006.01) |
| ***C11D 3/22*** | (2006.01) |
| ***C11D 3/386*** | (2006.01) |
| ***C11D 17/00*** | (2006.01) |

(52) U.S. Cl.
CPC *C11D 3/42* (2013.01); *C11D 3/046* (2013.01); *C11D 17/0039* (2013.01)

(58) Field of Classification Search
USPC ..... 510/324, 349, 441, 445
See application file for complete search history.

(56) References Cited

U.S. PATENT DOCUMENTS

| | | | | |
|---|---|---|---|---|
| 2,480,579 | A | 8/1949 | Holuba | |
| 3,521,805 | A | 7/1970 | Ward | |
| 3,887,614 | A | 6/1975 | Susuki et al. | |
| 3,989,635 | A | 11/1976 | Toyoda | |
| 4,269,722 | A | 5/1981 | Joshi et al. | |
| 4,308,625 | A | 1/1982 | Kitko | |
| 4,664,817 | A | 5/1987 | Wixon | |
| 4,965,015 | A | 10/1990 | Heybourne | |
| 5,002,681 | A * | 3/1991 | Wierenga et al. | 510/297 |
| 6,114,297 | A | 9/2000 | Yamaguchi | |
| 6,159,920 | A * | 12/2000 | Ridyard | 510/324 |
| 6,284,722 | B1 | 9/2001 | Yamaguchi | |
| 6,579,838 | B2 * | 6/2003 | Housmekerides et al. | 510/309 |
| 6,596,683 | B1 | 7/2003 | Ebihara | |
| 6,653,269 | B2 * | 11/2003 | Housmekerides et al. | 510/309 |
| 6,730,652 | B1 | 5/2004 | Painter et al. | |
| 6,747,000 | B2 | 6/2004 | Pearce | |
| 6,846,795 | B2 | 1/2005 | Lant | |
| 6,858,572 | B1 | 2/2005 | Mort, III | |
| 7,022,660 | B1 | 4/2006 | Mort et al. | |
| 2002/0198133 | A1 | 12/2002 | Behler | |
| 2003/0042167 | A1 | 3/2003 | Balz | |
| 2004/0011693 | A1 | 1/2004 | Prenger | |
| 2004/0198629 | A1 | 10/2004 | Raehse | |
| 2004/0235704 | A1 | 11/2004 | Wasserman | |
| 2006/0019860 | A1 | 1/2006 | Cardozo | |
| 2006/0160717 | A1 | 7/2006 | Itakura | |
| 2009/0308414 | A1 | 12/2009 | Gibis | |
| 2010/0069282 | A1 | 3/2010 | Prabhat | |
| 2010/0132704 | A1 | 6/2010 | Djinovic | |

FOREIGN PATENT DOCUMENTS

| | | | |
|---|---|---|---|
| DE | 4220649 | | 1/1994 |
| DE | 4313137 | | 10/1994 |
| DE | 19954959 | | 5/2001 |
| DE | 10044118 | | 4/2002 |
| DE | 202004006632 | | 9/2004 |
| DE | 102006034900 | | 1/2008 |
| DE | 102006034900 | A1 | 1/2008 |
| DE | 102008010085 | | 8/2009 |
| EP | 0057611 | A2 | 8/1982 |
| EP | 0388389 | | 9/1990 |
| EP | 0391087 | | 10/1990 |
| EP | EP0567140 | A1 | 10/1993 |
| EP | 0877079 | A1 | 11/1998 |

(Continued)

OTHER PUBLICATIONS

PCT International Search Report in PCT application PCT/EP2011/065124 dated Jan. 20, 2012 with Written Opinion.
European Search Report in EP application EP 10 18 7495 dated Mar. 8, 2011.
PCT International Search Report in PCT application PCT/EP2011/065150 dated Dec. 16, 2011 with Written Opinion.
European Search Report in EP application EP 10 18 7511 dated Mar. 21, 2011.
Co-pending Application: Applicant: Batchelor et al., U.S. Appl. No. 13/878,447, filed Jul. 12, 2013.
PCT International Search Report in PCT application PCT/EP2011/065152 dated Dec. 15, 2011 with Written Opinion.
European Search Report in EP application EP 10 18 7512 dated Mar. 23, 2011.

(Continued)

*Primary Examiner* — Lorna M Douyon
(74) *Attorney, Agent, or Firm* — Greenberg Traurig, LLP

(57) ABSTRACT

A particulate detergent composition comprising sulphonated fluorescer, wherein the composition comprises greater than 40 wt % detergent surfactant, at least 70% by number of the particles comprising a core, comprising mainly surfactant, and around the core a coating, comprising water soluble inorganic salt and sulphonated fluorescer, each particle having perpendicular dimensions x, y and z, wherein x is from 0.2 to 2 mm, y is from 2.5 to 8 mm, and z is from 2.5 to 8 mm.

9 Claims, No Drawings

(56) References Cited

FOREIGN PATENT DOCUMENTS

| | | | |
|---|---|---|---|
| EP | 0903405 | | 3/1999 |
| EP | 0962424 | A1 | 12/1999 |
| EP | 1081219 | A2 | 3/2001 |
| EP | 2166077 | A1 | 3/2010 |
| GB | 688752 | | 3/1953 |
| GB | 2076011 | | 11/1981 |
| GB | 2386130 | | 9/2003 |
| JP | 06-087742 | B | 11/1994 |
| WO | WO9325729 | | 12/1993 |
| WO | WO9932599 | | 7/1999 |
| WO | WO0078912 | A1 | 12/2000 |
| WO | WO2006032327 | | 3/2006 |
| WO | WO2008090091 | A1 | 7/2008 |
| WO | WO2010069957 | | 6/2010 |
| WO | WO2010122050 | A2 | 10/2010 |
| WO | WO2010122051 | A1 | 10/2010 |

OTHER PUBLICATIONS

Co-pending Application: Applicant: Batchelor et al., U.S. Appl. No. 13/878,448, filed Jul. 8, 2013.

PCT International Search Report in PCT application PCT/EP2011/065153 dated Dec. 5, 2011 with Written Opinion.

European Search Report in EP application EP 10 18 7513 dated Mar. 16, 2011.

Co-pending Application: Applicant: Batchelor et al., U.S. Appl. No. 13/878,450, filed Jul. 12, 2013.

PCT International Search Report in PCT application PCT/EP2011/065154 dated Dec. 16, 2011 with Written Opinion.

European Search Report in EP application EP 10 18 7514 dated Mar. 23, 2011.

Co-pending Application: Applicant: Batchelor et al., U.S. Appl. No. 13/878,451, filed Jul. 12, 2013.

PCT International Search Report in PCT application: PCT/EP2011/057309 dated Jul. 15, 2011 with Written Opinion.

European Search Report in EP application EP 10 18 7506 dated Mar. 16, 2011.

Co-pending Application: Applicant: Bonsall et al., U.S. Appl. No. 13/878,456, filed Jul. 8, 2013.

PCT International Search Report in PCT application PCT/EP2011/057310 dated Sep. 14, 2011 with Written Opinion.

Co-pending Application: Applicant: Bonsall et al., U.S. Appl. No. 13/878,459, filed Apr. 9, 2013.

PCT International Search Report in PCT application PCT/EP2011/063748 dated Nov. 9, 2011 with Written Opinion.

European Search Report in EP application EP 10 18 7494 dated Mar. 4, 2011.

Co-pending Application: Applicant: Bonsall et al., U.S. Appl. No. 13/878,440, filed Jul. 18, 2013.

PCT International Search Report in PCT application PCT/EP2011/065149 dated Dec. 20, 2011 with Written Opinion.

European Search Report in EP application EP 10 18 7509 dated Mar. 16, 2011.

Co-pending Application: Applicant: Batchelor et al., U.S. Appl. No. 13/878,442, filed Jul. 12, 2013.

PCT International Search Report in PCT application PCT/EP2011/067735 dated Jan. 23, 2012 with Written Opinion.

European Search Report in EP application EP 10 18 7520 dated Mar. 7, 2011.

PCT International Search Report in PCT application PCT/EP2011/067159 dated Jan. 25, 2012 with Written Opinion.

European Search Report in EP application EP 10 18 7500 dated Mar. 28, 2011.

Anonymous, Physical Properties in sugar esters, Physical Properties in sugar esters, Dec. 27, 2001, 1-3.

Kilcast et al., Sensory perception of creaminess and its relationship with food structure, Food Quality and Preference, Jun. 20, 2002, 609-623, 13.

Nelen, Sucrose Esters, Emulsifiers in Food Technology, 2004, 131-161, Chapter 6, Blackwell Publishing Ltd, GB.

W. Herbst et al, Industrial Organic Pigments, Industrial Organic Pigments, Dec. 1992, Index.

* cited by examiner

PARTICULATE DETERGENT COMPOSITIONS COMPRISING FLUORESCER

TECHNICAL FIELD

This invention relates to particulate detergent compositions comprising fluorescer, particularly to such compositions comprising at least 40 wt % surfactant in particles having an extruded surfactant core and an inorganic coating comprising from 5 to 45 wt % of the particles.

BACKGROUND

Particulate detergent compositions with improved environmental profiles could, in theory, be designed by eliminating all components from the composition that provide limited, or no, cleaning action. Such compact products would also reduce packaging requirements. However, to achieve this objective is difficult in practice because the manufacture of particulate detergent compositions usually requires the use of components that do not contribute significantly to detergency, but are nevertheless included to structure liquid ingredients into solids, to assist with processing and to improve the handling and stability of the particulate detergent compositions.

In our pending applications, PCT/EP2010/055256 and PCT/EP2010/055257 we propose to solve these problems by manufacturing a new particulate detergent composition. In general, the manufacture is done using a process comprising the steps of drying a surfactant blend, extruding it and cutting the extrudates to form hard core particles with a diameter of greater than 2 mm and a thickness greater than 0.2 mm. These large core particles are then preferably coated, especially with an inorganic coating.

Compositions comprising at least 70 wt % of these coated large particles with extruded surfactant cores differ from prior art extruded detergent compositions in that they have little or no solid structuring material to harden or structure the surfactant core. Instead, they use blends of low moisture surfactants to give hardness. The choice of surfactant allows the particles to give good detergency even without any conventional detergent builder, thus eliminating the need for such builders in the particles. Although the extruded particles are hard enough to cut to the required shape without deformation, they are hygroscopic and would stick together if not coated. It is therefore advantageous to coat the core particles by spraying inorganic material, such as sodium carbonate, onto them, in a fluid bed. The combination of the coating and the large particle size (5 mm diameter) substantially eliminates any tendency to deform or cake and allows production of a novel free-flowing composition of larger than usual detergent particles with excellent smooth and uniform appearance. Surprisingly, despite their large volume and high density, the particles are fast dissolving with low residues and form clear wash liquors with excellent primary detergency.

For fabric washing it is conventional to use a fabric substantive optical whitening agent or fluorescer in the detergent composition. Problems were encountered when a sulphonated fluorescer was added to the core of the particles as described in the above referenced co-pending applications.

GB2076011 notes that some sulphonated optical brighteners are coloured but can be rendered white in the presence of hydroxyl containing compounds. PEG is a suitable hydroxyl containing compound and in admixture with PEG the fluorescers turned from yellow-green to white. The molten mix could be flaked or alternatively it is suggested, but not exemplified, to use it to spray it onto detergent granules in a fluid bed (page 4 line 40).

U.S. Pat. No. 6,159,920 makes a fluorescer coated detergent particle by spaying on a mixture of fluorescer and nonionic surfactant. It is essential that the coating is anhydrous. Spraying is done in a Lödige mixer. A preferred fluorescer is Tinopal CBS.

DE 10 2006 034 900 A1 discloses a method of applying fluorescer to a porous detergent powder.

SUMMARY OF THE INVENTION

According to the present invention there is provided a coated particulate detergent composition comprising sulphonated fluorescer, wherein the composition comprises greater than 50 wt % detergent surfactant, at least 70% by number of the particles comprising a core, comprising mainly surfactant, and a coating, comprising water soluble inorganic salt and sulphonated fluorescer, each particle having perpendicular dimensions x, y and z, wherein x is from 0.2 to 2 mm, y is from 2.5 to 8 mm (preferably 3 to 8 mm), and z is from 2.5 to 8 mm (preferably 3 to 8 mm), the particles being substantially the same shape and size as one another.

The amount of fluorescer containing coating on each coated particle may be from 5 to 45, preferably from 10 to 45, more preferably 20 to 35% by weight of the particles.

The number percentage of the composition of particles comprising the core and fluorescer containing coating is preferably at least 85%.

The coated particles preferably further comprise from 0.001 to 3 wt % perfume.

The core of the coated particles preferably comprises less than 5 wt %, even more preferably less than 2.5 wt % inorganic materials.

The coating preferably comprises sulphonated fluorescer and sodium carbonate, optionally in admixture with a minor amount of Sodium carboxy methyl cellulose and further optionally in admixture with one or more of sodium silicate, water soluble, or water dispersible, shading dye and pigment or coloured dye.

The detergent particles are desirably oblate spheroids with diameter of 3 to 6 mm and thickness of 1 to 2 mm.

At least some, and preferably a major portion by number of the particles may be coloured other than white.

The particles may be packaged in any of the conventionally employed types of packaging. The package may be of any convenient size.

Compositions with up to 100 wt % of the particles are possible when basic additives are incorporated into the extruded particles, or into their coating. The composition may also comprise, for example, an antifoam granule. The coated detergent particle preferably has a core to shell (coating) ratio of from 3 to 1:1 by weight more preferably 2.5 to 1.5 to 1 and optionally about 2:1.

The Fluorescer

The coated detergent particle comprises a sulphonated fluorescent agent or fluorescer (optical brightener) in the coating. Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 1 wt %.

The fluorescer is sulphonated. Suitably it is used in the form of its sodium salt. Suitable fluorescer may be selected from the group comprising disulphonated distyrylbiphenyls, disulphonated triazinylaminostilbenes, bis(1,2,3-triazol-2-yl)stilbenes, bis(benzo[b]furan-2-yl)biphenyls, and 1,3-diphenyl-2-pyrazolines.

Preferred fluorescers are disodium 4,4'-bis(2-sulfostyryl) biphenyl, sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2'disulfonate, disodium 4,4'-bis{[(4-anilino-6-morpholino-1,3,5-triazin-2-yl)]amino}stilbene-2-2'disulphonate, Tinopal® DMS is the disodium salt of 4,4'-bis{[(4-anilino-6-morpholino-1,3,5-triazin-2-yl)]amino}stilbene-2-2'disulphonate.

4,4'-bis-(2-diethanolamino-4-anilino-s-triazin-6-ylamino) stilbene-2,2'-disulphonate;

4,4'-bis-(2,4-dianilino-s-triazin-6-ylamino) stilbene-2.2'-disulphonate;

4,4'-bis-(4-phenyl-2,1,3-triazol-2-yl)stilbene-2,2'-disulphonate;

4,4'-bis-(2-anilino-4(1-methyl-2-hydroxy-ethylamino)-s-triazin-6-ylamino) stilbene-2,2'-disulphonate;

2-(stilbyl-4"-naptho-I,2':4,5)-I,2,3-trizole-2"-sulphonate

Particularly preferred fluorescers are Tinopal (Trade Mark) CBS-X, Di-amine stilbene di-sulphonic acid compounds, e.g. Tinopal DMS pure Xtra and Blankophor (Trade Mark) HRH, Pyrazoline compounds, e.g. Blankophor SN and Tinopal® CBS, the disodium salt of 4,4'-bis(2-sulfostyryl)biphenyl. Tinopal® DMS and Tinopal® CBS are available from BASF, Basel, Switzerland.

Preferably a dye, most preferably a blue dye, is also included in the coating solution.

Placing the fluorescer in the coating not only improves the appearance of the coating, but it also reduces the transmission of ultra violet light into the core of the particle. This is advantageous if there are components in the core that would be damaged by UV radiation, particularly UVB radiation that can deactivate enzymes such as protease even at very low levels of radiation. This advantage becomes particularly important if the particles are distributed in a clear container such as would more normally be used for a liquid composition. Suitable clear containers are fabricated from UV transmitting PET or clarified polypropylene.

DETAILED DESCRIPTION OF THE INVENTION

The particles are formed from a core comprising surfactant and a coating or shell applied to the core. The appearance of the coated particles is very pleasing if the core particle is formed by extrusion.

Manufacture of the Particles

A preferred manufacturing process is set forth in PCT/EP2010/055256. It comprises blending surfactants together and then drying them to a low moisture content of less than 1%. Scraped film devices may be used. A preferred form of scraped film device is a wiped film evaporator. One such suitable wiped film evaporator is the "Dryex system" based on a wiped film evaporator available from Ballestra S.p.A. Alternative drying equipment includes tube-type driers, such as a Chemithon Turbo Tube® drier, and soap driers. The hot material exiting the scraped film drier is subsequently cooled and broken up into suitable sized pieces to feed to the extruder. Simultaneous cooling and breaking into flakes may conveniently be carried out using a chill roll. If the flakes from the chill roll are not suitable for direct feed to the extruder then they can be milled in a milling apparatus and/or they can be blended with other liquid or solid ingredients in a blending and milling apparatus, such as a ribbon mill. Such milled or blended material is desirably of particle size 1 mm or less for feeding to the extruder.

It is particularly advantageous to add a milling aid at this point in the process. Particulate material with a mean particle size of 10 nm to 10 μm is preferred for use as a milling aid. Among such materials, there may be mentioned, by way of example: Aerosil®, Alusil®, and Microsil®.

Extruding and Cutting

The dried surfactant blend is then extruded. The extruder provides further opportunities to blend in ingredients other than surfactants, or even to add further surfactants. However, it is generally preferred that all of the anionic surfactant, or other surfactant supplied in admixture with water; i.e. as paste or as solution, is added into the drier to ensure that the water content can then be reduced and the material fed to and through the extruder is sufficiently dry. Additional materials that can be blended into the extruder are thus mainly those that are used at very low levels in a detergent composition: such as fluorescer, shading dye, enzymes, perfume, silicone antifoams, polymeric additives and preservatives. The limit on such additional materials blended in the extruder has been found to be about 10 wt %, but it is preferred for product quality to be ideal to keep it to a maximum of 5 wt %. Solid additives are generally preferred. Liquids, such as perfume may be added at levels up to 2.5 wt %, preferably up to 1.5 wt %. Solid particulate structuring (liquid absorbing) materials or builders, such as zeolite, carbonate, silicate are preferably not added to the blend being extruded. These materials are not needed due to the self structuring properties of the very dry LAS-based feed material. If any is used the total amount should be less than 5 wt %, preferably less than 4 wt %, most preferably less than 3 wt %. At such levels no significant structuring occurs and the inorganic particulate material is added for a different purpose, for instance as a flow aid to improve the feed of particles to the extruder. The output from the extruder is shaped by the die plate used. The extruded material has a tendency to swell up in the centre relative to the periphery. We have found that if a cylindrical extrudate is regularly sliced as it exits the extruder the resulting shapes are short cylinders with two convex ends. These particles are herein described as oblate spheroids, or lentils. This shape is pleasing visually.

Coating

The sliced extruded particles are then coated. Coating allows the particles to be coloured easily. Coating makes the particles more suitable for use in detergent compositions that may be exposed to high humidity for long periods.

The extruded particles can be considered as oblate spheroids with a major radius "a" and minor radius "b". Hence, the surface area(S) to volume (V) ratio can be calculated as:

$$\frac{S}{V} = \frac{3}{2b} + \frac{3b}{4 \in a^2} \ln\left(\frac{1+\in}{1-\in}\right)_{mm-1}$$

When $\epsilon$ is the eccentricity of the particle.

Although the skilled person might assume that any known coating may be used, for instance organic, including polymer, it has been found to be particularly advantageous to use an inorganic coating deposited by crystallisation from an aqueous solution as this appears to give positive dissolution benefits and the coating gives a good colour to the detergent particle, even at lower coating levels. An aqueous spray-on of coating solution in a fluidised bed may also generate a further slight rounding of the detergent particles during the fluidisation process.

Suitable inorganic coating solutions include sodium carbonate, possibly in admixture with sodium sulphate, and sodium chloride. Food dyes, shading dyes, fluorescer and other optical modifiers can be added to the coating by dissolving them in the spray-on solution or dispersion. Use of a builder salt such as sodium carbonate is particularly advantageous because it allows the detergent particle to have an even better performance by buffering the system in use at an ideal pH for maximum detergency of the anionic surfactant system. It also increases ionic strength, which is known to improve cleaning in hard water, and it is compatible with other detergent ingredients that may be admixed with the coated extruded detergent particles. If a fluid bed is used to apply the coating solution, the skilled worker will know how to adjust the spray conditions in terms of Stokes number and possibly Akkermans number (FNm) so that the particles are coated and not significantly agglomerated. Suitable teaching to assist in this may be found in EP1187903, EP993505 and Powder technology 65 (1991) 257-272 (Ennis).

It will be appreciated by those skilled in the art that multiple layered coatings, of the same or different coating materials, could be applied, but a single coating layer is preferred, for simplicity of operation, and to maximise the thickness of the coating. The amount of coating should lie in the range 3 to 50 wt % of the particle, preferably 20 to 40 wt % for the best results in terms of anti-caking properties of the detergent particles.

The Extruded Particulate Detergent Composition

The coated particles dissolve easily in water and leave very low or no residues on dissolution, due to the absence of insoluble structurant materials such as zeolite. The coated particles have an exceptional visual appearance, due to the smoothness of the coating coupled with the smoothness of the underlying particles, which is also believed to be a result of the lack of particulate structuring material in the extruded particles.

Compositions with up to 100 wt % of the particles are possible when basic additives are incorporated into the extruded particles, or into their coating. The composition may also comprise, for example, an antifoam granule.

Shape and Size

The coated detergent particles are larger and less spherical than conventional detergent powders. The coated detergent particle is preferably curved. The coated detergent particle is most preferably lenticular (shaped like a whole dried lentil), an oblate ellipsoid, where z and y are the equatorial diameters and x is the polar diameter; preferably y=z. The size is such that y and z are at least 2.5 mm, preferably at least 4 mm, and x lies in the range 0.2 to 2 mm, preferably 1 to 2 mm.

The coated laundry detergent particle may be shaped as a disc.

Core Composition

The core is primarily surfactant. It may also include detergency additives, such as perfume, shading dye, enzymes, cleaning polymers and soil release polymers.

Surfactant

The coated laundry detergent particle comprises between 40 to 90 wt % of a surfactant, most preferably 55 to 90 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside Taschenbuch", H. Stache, 2nd Edn., Carl Hauser Verlag, 1981. Preferably the surfactants used are saturated.

1) Anionic Surfactants

Suitable anionic detergent compounds that may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher C8 to C18 alcohols, produced for example from tallow or coconut oil, sodium and potassium alkyl C9 to C20 benzene sulphonates, particularly sodium linear secondary alkyl C10 to C15 benzene sulphonates; and sodium alkyl glyceryl ether sulphates, especially those ethers of the higher alcohols derived from tallow or coconut oil and synthetic alcohols derived from petroleum. Most preferred anionic surfactants are sodium lauryl ether sulphate (SLES), particularly preferred with 1 to 3 ethoxy groups, sodium C10 to C15 alkyl benzene sulphonates and sodium C12 to C18 alkyl sulphates. Also applicable are surfactants such as those described in EP-A-328 177 (Unilever), which show resistance to salting out, the alkyl polyglycoside surfactants described in EP-A-070 074, and alkyl monoglycosides. The chains of the surfactants may be branched or linear.

Soaps may also be present. The fatty acid soap used preferably contains from about 16 to about 22 carbon atoms, preferably in a straight chain configuration. The anionic contribution from soap may be from 0 to 30 wt % of the total anionic.

Use of more than 10 wt % soap is not preferred.

Preferably, at least 50 wt % of the anionic surfactant is selected from: sodium C11 to C15 alkyl benzene sulphonates; and, sodium C12 to C18 alkyl sulphates.

Preferably, the anionic surfactant is present in the coated laundry detergent particle at levels between 15 to 85 wt %, more preferably 50 to 80 wt %.

2) Non-Ionic Surfactants

Suitable non-ionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Preferred nonionic detergent compounds are C6 to C22 alkyl phenol-ethylene oxide condensates, generally 5 to 25 EO, i.e. 5 to 25 units of ethylene oxide per molecule, and the condensation products of aliphatic C8 to C18 primary or secondary linear or branched alcohols with ethylene oxide, generally 5 to 50 EO. Preferably, the non-ionic is 10 to 50 EO, more preferably 20 to 35 EO. Alkyl ethoxylates are particularly preferred.

Preferably the non-ionic surfactant is present in the coated laundry detergent particle at levels between 5 to 75 wt %, more preferably 10 to 40 wt %.

Cationic surfactant may be present as minor ingredients at levels preferably between 0 to 5 wt %.

Preferably all the surfactants are mixed together before being dried. Conventional mixing equipment may be used. The surfactant core of the laundry detergent particle may be formed by roller compaction and subsequently coated with an inorganic salt.

Calcium Tolerant Surfactant System

In another aspect the core is calcium tolerant and this is a preferred aspect because this reduces the need for a builder.

Surfactant blends that do not require builders to be present for effective detergency in hard water are preferred. Such blends are called calcium tolerant surfactant blends if they pass the test set out hereinafter. However, the invention may also be of use for washing with soft water, either naturally occurring or made using a water softener. In this case, calcium tolerance is no longer important and blends other than calcium tolerant ones may be used.

Calcium-tolerance of the surfactant blend is tested as follows:

The surfactant blend in question is prepared at a concentration of 0.7 g surfactant solids per liter of water containing sufficient calcium ions to give a French hardness of 40 (4×10-3 Molar Ca2+). Other hardness ion free electrolytes such as sodium chloride, sodium sulphate, and sodium hydroxide are added to the solution to adjust the ionic strength to 0.05M and the pH to 10. The adsorption of light of wavelength 540 nm through 4 mm of sample is measured 15 minutes after sample preparation. Ten measurements are made and an average value is calculated. Samples that give an absorption value of less than 0.08 are deemed to be calcium tolerant.

Examples of surfactant blends that satisfy the above test for calcium tolerance include those having a major part of LAS surfactant (which is not of itself calcium tolerant) blended with one or more other surfactants (co-surfactants) that are calcium tolerant to give a blend that is sufficiently calcium tolerant to be usable with little or no builder and to pass the given test. Suitable calcium tolerant co-surfactants include SLES 1-7EO, and alkyl ethoxylate non-ionic surfactants, particularly those with melting points less than 40° C.

A LAS/SLES surfactant blend has a superior foam profile to a LAS Nonionic surfactant blend and is therefore preferred for hand washing formulations requiring high levels of foam. SLES may be used at levels of up to 30%. A preferred calcium tolerant coated laundry detergent particle comprises 15 to 100 wt % anionic surfactant of which 20 to 30 wt % is sodium lauryl ether sulphate.

A LAS/NI surfactant blend provides a harder particle and its lower foam profile makes it more suited for automatic washing machine use.

The Coating

The main components of the coating are a water soluble inorganic salt and a sulphonated fluorescer. The fluorescer is as described above. Other water compatible ingredients may be included in the coating. For example film forming polymers such as sodium carboxy methyl cellulose, shading dye, silicate, pigments and dyes.

Water Soluble Inorganic Salts

The water soluble inorganic salts are preferably selected from sodium carbonate, sodium chloride, sodium silicate and sodium sulphate, or mixtures thereof, most preferably 70 to 100 wt % sodium carbonate. The water soluble inorganic salt is present as a coating on the particle. The water soluble inorganic salt is preferably present at a level that reduces the stickiness of the laundry detergent particle to a point where the particles are free flowing.

It will be appreciated by those skilled in the art that multiple layered coatings, of the same or different coating materials, could be applied, but a single coating layer is preferred, for simplicity of operation, and to maximise the thickness of the coating. The amount of coating should lay in the range 5 to 45 wt % of the particle, preferably 20 to 40 wt %, even more preferably 25 to 35 wt % for the best results in terms of anti-caking properties of the detergent particles and control of the flow from the package.

The coating is applied to the surface of the surfactant core, by crystallisation from an aqueous solution of the water soluble inorganic salt. The aqueous solution preferably contains greater than 50 g/L, more preferably 200 g/L of the salt. An aqueous spray-on of the coating solution in a fluidised bed has been found to give good results and may also generate a slight rounding of the detergent particles during the fluidisation process. Drying and/or cooling may be needed to finish the process.

By coating the large detergent particles of the current invention the thickness of coating obtainable by use of a coating level of say 5 wt % is much greater than would be achieved on typically sized detergent granules (0.5-2 mm diameter sphere).

For optimum dissolution properties, this surface area to volume ratio must be greater than 3 $mm^{-1}$. However, the coating thickness is inversely proportional to this coefficient and hence for the coating the ratio "Surface area of coated particle" divided by "Volume of coated particle" should be less than 15 $mm^{-1}$.

The Coated Detergent Particle

The coated detergent particles comprise from 70 to 100 wt %, preferably 85 to 90 wt %, of a detergent composition.

Preferably, the coated detergent particles are substantially the same shape and size by this is meant that at least 90 to 100% of the coated detergent particles in the in the x, y and z dimensions are within a 20%, preferably 10%, variable from the largest to the smallest coated detergent particle in the corresponding dimension.

Water Content

The coated particles preferably comprise from 0 to 15 wt % water, more preferably 0 to 10 wt %, most preferably from 1 to 5 wt % water, at 293K and 50% relative humidity. This facilitates the storage stability of the particle and its mechanical properties.

Other Ingredients

The ingredients described below may be present in the coating or the core.

Dye

Dye may advantageously be added to the coating; it may also or alternatively be added to the core. In that case preferably the dye is dissolved in the surfactant before the core is formed.

Dyes are described in Industrial Dyes edited by K. Hunger 2003 Wiley-VCH ISBN 3-527-30426-6.

Dyes are selected from anionic and non-ionic dyes Anionic dyes are negatively charged in an aqueous medium at pH 7. Examples of anionic dyes are found in the classes of acid and direct dyes in the Color Index (Society of Dyers and Colourists and American Association of Textile Chemists and Colorists). Anionic dyes preferably contain at least one sulphonate or carboxylate groups. Non-ionic dyes are uncharged in an aqueous medium at pH 7, examples are found in the class of disperse dyes in the Color Index.

The dyes may be alkoxylated. Alkoxylated dyes are preferably of the following generic form: Dye-NR1R2. The NR1R2 group is attached to an aromatic ring of the dye. R1 and R2 are independently selected from polyoxyalkylene chains having 2 or more repeating units and preferably having 2 to 20 repeating units. Examples of polyoxyalkylene chains include ethylene oxide, propylene oxide, glycidol oxide, butylene oxide and mixtures thereof.

A preferred polyoxyalkylene chain is [(CH2CR3HO)x (CH2CR4HO)yR5) in which x+y≤5 wherein y≥1 and z=0 to 5, R3 is selected from: H; CH3; CH2O(CH2CH2O)zH and mixtures thereof; R4 is selected from: H; CH2O(CH2CH2O) zH and mixtures thereof; and, R5 is selected from: H; and, CH3

A preferred alkoxylated dye for use in the invention is:

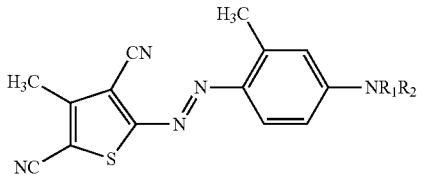

Preferably the dye is selected from acid dyes; disperse dyes and alkoxylated dyes.

Most preferably the dye is a non-ionic dye.

Preferably the dye is selected from those having: anthraquinone; mono-azo; bis-azo; xanthene; phthalocyanine; and, phenazine chromophores. More preferably the dye is selected from those having: anthraquinone and, mono-azo chromophores.

In a preferred process, the dye is added to the coating slurry and agitated before applying to the core of the particle. Application may be by any suitable method, preferably spraying on to the core particle as detailed above.

The dye may be any colour, preferable the dye is blue, violet, green or red. Most preferably the dye is blue or violet.

Preferably the dye is selected from: acid blue 80, acid blue 62, acid violet 43, acid green 25, direct blue 86, acid blue 59, acid blue 98, direct violet 9, direct violet 99, direct violet 35, direct violet 51, acid violet 50, acid yellow 3, acid red 94, acid red 51, acid red 95, acid red 92, acid red 98, acid red 87, acid yellow 73, acid red 50, acid violet 9, acid red 52, food black 1, food black 2, acid red 163, acid black 1, acid orange 24, acid yellow 23, acid yellow 40, acid yellow 11, acid red 180, acid red 155, acid red 1, acid red 33, acid red 41, acid red 19, acid orange 10, acid red 27, acid red 26, acid orange 20, acid orange 6, sulphonated Al and Zn phthalocyanines, solvent violet 13, disperse violet 26, disperse violet 28, solvent green 3, solvent blue 63, disperse blue 56, disperse violet 27, solvent yellow 33, disperse blue 79:1.

The dye is preferably a shading dye for imparting a perception of whiteness to a laundry textile.

The dye may be covalently bound to polymeric species.

A combination of dyes may be used.

Perfume

Preferably, the composition comprises a perfume. The perfume is preferably in the range from 0.001 to 3 wt %, most preferably 0.1 to 1 wt %. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6(2):80 [1955]). Preferred top-notes are selected from citrus oils, linalool, linalyl acetate, lavender, dihydromyrcenol, rose oxide and cis-3-hexanol.

The perfume may be added into the core either as a liquid or as encapsulated perfume particles. The perfume may be mixed with a nonionic material and applied as a coating the extruded particles, for example by spraying it mixed with molten nonionic surfactant. Perfume may also be introduced into the composition by means of a separate perfume granule and then the detergent particle does not need to comprise any perfume.

It is preferred that the coated detergent particles do not contain a peroxygen bleach, e.g., sodium percarbonate, sodium perborate, peracid.

Polymers

The composition may comprise one or more further polymers. Examples are carboxymethylcellulose, poly (ethylene glycol), poly(vinyl alcohol), polyethylene imines, ethoxylated polyethylene imines, water soluble polyester polymers polycarboxylates such as polyacrylates, maleic/acrylic acid copolymers and lauryl methacrylate/acrylic acid copolymers.

Enzymes

One or more enzymes are preferably present in the composition.

Preferably the level of each enzyme is from 0.0001 wt % to 0.5 wt % protein.

Especially contemplated enzymes include proteases, alpha-amylases, cellulases, lipases, peroxidases/oxidases, pectate lyases, and mannanases, or mixtures thereof.

Suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas lipase*, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus lipase*, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202, WO 00/60063, WO 09/107,091 and WO09/111, 258.

Preferred lipase enzymes include Lipolase™ and Lipolase Ultra™, Lipex™ (Novozymes A/S) and Lipoclean™.

The method of the invention may be carried out in the presence of phospholipase classified as EC 3.1.1.4 and/or EC 3.1.1.32. As used herein, the term phospholipase is an enzyme that has activity towards phospholipids.

Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes that participate in the hydrolysis of phospholipids. Several types of phospholipase activity can be distinguished, including phospholipases A1 and A2 which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

Suitable proteases include those of animal, vegetable or microbial origin.

Microbial origin is preferred. Chemically modified or protein engineered mutants are included. The protease may be a serine protease or a metallo protease, preferably an alkaline microbial protease or a trypsin-like protease. Suitable protease enzymes include Alcalase™, Savinase™, Primase™, Duralase™, Dyrazym™, Esperase™, Everlase™, Polarzyme™, and Kannase™, (Novozymes A/S), Maxatase™, Maxacal™, Maxapem™, Properase™, Purafect™, Purafect OxP™, FN2™, and FN3™ (Genencor International Inc.).

The method of the invention may be carried out in the presence of cutinase. classified in EC 3.1.1.74. The cutinase used according to the invention may be of any origin. Preferably, cutinases are of microbial origin, in particular of bacterial, of fungal or of yeast origin.

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp. strains disclosed in WO 95/026397 or WO 00/060060. Suitable amylases are Duramyl™, Termamyl™, Termamyl Ultra™, Natalase™, Stainzyme™, Fungamyl™ and BAN™ (Novozymes A/S), Rapidase™ and Purastar™ (from Genencor International Inc.).

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Thielavia terrestris, Myceliophthora thermophila*, and *Fusarium oxysporum* disclosed in U.S. Pat. No. 4,435,307, U.S. Pat. No. 5,648,263, U.S. Pat. No. 5,691,178, U.S. Pat. No. 5,776,757, WO 89/09259, WO 96/029397, and WO 98/012307. Cellulases include Celluzyme™, Carezyme™, Endolase™, Renozyme™ (Novozymes A/S), Clazinase™ and Puradax HA™ (Genencor International Inc.), and KAC-500(B)™ (Kao Corporation).

Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Peroxidases include Guardzyme™ and Novozym™ 51004 (Novozymes A/S).

Further suitable enzymes are disclosed in WO2009/087524, WO2009/090576, WO2009/148983 and WO2008/007318.

Enzyme Stabilizers

Any enzyme present in the composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

Sequestrants may be present in the detergent particles.

The invention will now be further described with reference to the following non-limiting examples.

EXAMPLES

Example 1 and Comparative Example A

Surfactant raw materials were mixed together to give a 67 wt % active paste comprising 85 parts LAS and 15 parts Nonionic Surfactant.

Raw Materials used were:

Sodium linear alkyl benzene sulphonate (LAS): Unger Ufasan 65 Nonionic (NI) BASF Lutensol AO30

The paste was pre-heated to the feed temperature and fed to the top of a wiped film evaporator to reduce the moisture content and produce a solid intimate surfactant blend, which passed the calcium tolerance test. The conditions used to produce this LAS/NI blend are given in Table 1:

TABLE 1

| | | |
|---|---|---|
| | Jacket Vessel Temp. | 81° C. |
| Feed | Nominal Throughput | 55 kg/hr |
| | Temperature | 59° C. |
| | Density | 1.08 kg/l |
| Product | Moisture(KF*) | 0.85% |
| | Free NaOH | 0.06% |

*analysed by Karl Fischer method

On exit from the base of the wiped film evaporator, the dried surfactant blend dropped onto a chill roll, where it was cooled to less than 30° C.

After leaving the chill roll, the cooled dried surfactant blend particles were milled using a hammer mill, 2% Alusil® was also added to the hammer mill as a mill aid. The resulting milled material is hygroscopic and so it was stored in sealed containers. The cooled dried milled composition was fed to a twin-screw co-rotating extruder fitted with a shaped orifice plate and cutter blade. A number of other components were also dosed into the extruder as noted in Table 2:

TABLE 2

| Extruder (core) | Comparative Example A | Example 1 |
|---|---|---|
| LAS/NI mixture | 64.3 | 64.7 |
| SCMC | 1.0 | 1.0 |
| Fluorescer** | 0.75 | |
| Perfume | 0.75 | 0.75 |

**The fluorescer used was Tinopal CBSX - a sulphonated fluorescer.

The particles were then coated using a Strea 1 fluid bed. The coating was added as an aqueous solution and coating completed under conditions given in Table 3. Coating wt % is based on weight of the coated particle.

TABLE 3

| | Example | |
|---|---|---|
| | A | 1 |
| Mass Solid [kg] | 1.25 | 1.25 |
| Coating Solution | Sodium Carbonate (30%) | Sodium Carbonate (30%) Fluorescer** |
| Mass Coating Solution [kg] | 1.8 | 1.8 |
| Air Inlet Temperature [° C.] | 80 | 80 |
| Air Outlet Temperature [° C.] | 38 | 36 |
| Coating Feed Rate [g/min] | 16 | 17 |
| Coating Feed temperature [° C.] | 55 | 53 |

**The fluorescer used was Tinopal CBSX - a sulphonated fluorescer.

The properties of the material measured after coating given in Table 4:

TABLE 4

| Fluid bed (coating) | Example A | Example 1 |
|---|---|---|
| Carbonate | 27.5 | 28.2 |
| Fluorescer | | 0.75 |
| Impurities/Moisture | 5.7 | 4.6 |
| Colour | Yellow/Green | Off-White |

Example 1 shows that, surprisingly, the coated particle colour is improved when putting the fluorescer into the coating rather than in Comparative example A where it was extruded into the core of the particle. This was not the expected result. It was assumed that the particle would have less discoloration if the fluorescer was hidden away in the core of the particle.

Examples 2 and 3

The particles of examples 2 and 3 were prepared as described for example 1.

The desired product colour was a mixture of white and blue.

| | Example 2 | Example 3 Blue & White | |
|---|---|---|---|
| | (white) | Blue | White |
| Extruder (core) | | | |
| LAS/Nonionic mixture | 64.79 | 64.4 | 63.7 |
| SCMC | 1.0 | 1.0 | 1.0 |
| Fluorescer | | | |
| Perfume | 1.0 | 1.0 | 1.0 |
| Fluid bed (coating) | | | |
| Carbonate | 30 | 31.2 | 30.5 |
| Fluorescer | 0.21 | 0.32 | 0.04 |
| Blue Dye | 0 | 0.03 | |
| Impurities/Moisture | 3 | 2.05 | 3.76 |

Example 2, like example 1 was again near white.

By combining the majority of the fluorescer with a blue dye for the blue part of Example 3a further improvement in the white part of this example was obtained. Furthermore the blue seemed to be a brighter colour than a comparative example without inclusion of any fluorescer in the blue particles.

Comparative example taking the disclosure of to DE 10 2006 034 900 A1 and applying it to the large detergent particle.

1) Preparation of Fluorescer "solution"

A mix of 91.3 parts Lutensol AO 7 was placed on a beaker and its pH measured as 7. To this was added 8.7 parts Tinopal CBS-X that had previously been finely ground using a pestle and mortar.

The Lutensol/Fluorescer mixture was then homogenised using a Silverson (Model L4RT) high shear homogeniser.

2) Preparation of LAS/PAS/NI extrudates 1100 g of dried, milled surfactant blend (LAS/PAS/NI 68/17/15 by weight) was extruded using a ThermoFisher 24HC twin screw extruder, operated at a rate of 8 kg/hr. Inlet temperature of the extruder was set at 20° C., rising to 40° C. just prior to the die-plate. The die-plate used was drilled with 6 circular orifices of 5 mm diameter.

The extruded product was cut after the die-plate using a high speed cutter set up to produce a free flowing product with a thickness of 1 mm.

3) Coating of LAS/PAS/NI extrudates with sodium carbonate 764 g of the extrudates from example 2 were charged to the fluidising chamber of a Strea 1 laboratory fluid bed drier (Aeromatic-Fielder AG) and spray coated using 1069 g of a solution containing 320.7 g of sodium carbonate in 748.3 g of demin water, using a top-spray configuration.

The coating solution was fed to the spray nozzle of the Strea 1 via a peristaltic pump (Watson-Marlow model 101 U/R) at an initial rate of 3.3 g/min, rising to 9.1 g/min during the course of the coating trial.

The Fluid bed coater was operated with an initial air inlet air temperature of 55° C. increasing to 90° C. during the course of the coating trial whilst maintaining the outlet temperature in the range 45-50° C. throughout the coating process.

The resulting product was free flowing.

4) Preparation of extrudate with fluorescer 93.5 wt % of LAS/PAS/NI extrudate from (3) above was placed in a rotating drum mixer and 3.9 wt % of the Lutensol/Fluorescer preparation sprayed onto it. The resulting product was then powdered with 2.6 wt % of Wessalith P.

The resultant mixture formed into a sticky mass that did not flow freely.

5) Preparation of coated extrudate with fluorescer 93.5 wt % of LAS/PAS/NI extrudate from (4) above was placed in a rotating drum mixer and 3.9 wt % of the Lutensol/Fluorescer preparation sprayed onto it. The resulting product was then powdered with 2.6 wt % of Wessalith P.

The resultant mixture formed into a sticky mass that did not flow freely.

The invention claimed is:

1. A particulate detergent composition comprising:

(i) sulphonated fluorescer (ii) greater than 40 wt % detergent surfactant, and (iii) water soluble inorganic salt wherein at least 70% of a total number of particles in the particulate detergent composition consist of:

(a) a core consisting of the surfactant and optionally, at least one of perfume, enzyme, enzyme stabilizer, cleaning polymer, soil release polymer, water, carboxymethylcellulose, polyethylene glycol, polyvinyl alcohol, polyethylene imine, ethoxylated polyethylene imine, water soluble polyester polymer, polycarboxylate, polyacrylate, maleic/acrylic acid copolymer, or lauryl methacrylate/acrylic acid copolymer, and (b) a coating consisting of the water soluble inorganic salt and the sulphonated fluorescer, and optionally, at least one of perfume, enzyme, enzyme stabilizer, water, carboxymethylcellulose, polyethylene glycol, polyvinyl alcohol, polyethylene imine, ethoxylated polyethylene imine, water soluble polyester polymer, polycarboxylate, polyacrylate, maleic/acrylic acid copolymer, or lauryl methacrylate/acrylic acid copolymer;

wherein the coating is positioned around the core, and wherein each particle has perpendicular dimensions x, y and z, and wherein x is from 0.2 to 2 mm, y is from 2.5 to 8 mm, and z is from 2.5 to 8 mm.

2. A particulate detergent composition according to claim 1 wherein a level of fluorescer in the composition is from 0.005 wt % to 2 wt %.

3. A particulate detergent composition according to claim 1 wherein an amount of coating on each coated particle is from 5 to 45% by weight of the coated particle.

4. A particulate detergent composition according to claim 1 wherein at least 85% of the total number of the particles in the particulate detergent composition consist of the core and the coating.

5. A particulate detergent composition according to claim 1 wherein the detergent particles are oblate spheroids.

6. A particulate detergent composition according to claim 1 wherein the fluorescer is fabric substantive.

7. A particulate detergent composition according to claim 1 wherein x is from 1 to 2 mm and y and z are from 3 to 6 mm.

8. A particulate detergent composition according to claim 1 wherein a variation in x, y, and z is less than 20%.

9. A particulate detergent composition comprising:

(i) sulphonated fluorescer (ii) greater than 40 wt % detergent surfactant, (iii) water soluble inorganic salt; and (iv) 0.001 to 3 wt % perfume wherein at least 70% of a total number of particles in the particulate detergent composition consist of:

(a) a core consisting of the surfactant and the perfume and optionally, at least one of enzyme, enzyme stabilizer, cleaning polymer, soil release polymer, water, carboxymethylcellulose, polyethylene glycol, polyvinyl alcohol, polyethylene imine, ethoxylated polyethylene imine, water soluble polyester polymer, polycarboxylate, polyacrylate, maleic/acrylic acid copolymer, or lauryl methacrylate/acrylic acid copolymer, and (b) a coating consisting of the water soluble inorganic salt and the sulphonated fluorescer, and optionally, at least one of perfume, enzyme, enzyme stabilizer, water, carboxymethylcellulose, polyethylene glycol, polyvinyl alcohol, polyethylene imine, ethoxylated polyethylene imine, water soluble polyester polymer, polycarboxylate, polyacrylate, maleic/acrylic acid copolymer, or lauryl methacrylate/acrylic acid copolymer, and wherein the coating is positioned around the core, and wherein each particle has perpendicular dimensions x, y and z, and wherein x is from 0.2 to 2 mm, y is from 2.5 to 8 mm, and z is from 2.5 to 8 mm.

* * * * *